United States Patent [19]

Lofstrand

[11] Patent Number: 4,503,411

[45] Date of Patent: Mar. 5, 1985

[54] DUAL PLUNGER SOLENOID DEVICE

[75] Inventor: Warren A. Lofstrand, Enfield, Conn.

[73] Assignee: Cooper Industries, Houston, Tex.

[21] Appl. No.: 554,638

[22] Filed: Nov. 23, 1983

[51] Int. Cl.[3] ..... H01F 7/08

[52] U.S. Cl. ..... 335/259; 335/265; 335/267

[58] Field of Search ..... 335/255, 259, 265, 266, 335/267, 268

[56] References Cited

U.S. PATENT DOCUMENTS

| | | | |
|---|---|---|---|
| 766,117 | 7/1904 | Rundle | 335/259 X |
| 2,496,875 | 11/1958 | Waldhauer, Jr. | 200/103 |
| 3,012,578 | 12/1961 | Ludwig | 335/265 X |
| 3,344,377 | 9/1967 | Clements | 335/259 |
| 3,378,031 | 4/1968 | Hatashita | 335/265 |
| 3,430,120 | 2/1969 | Kotaka et al. | 335/267 X |
| 3,472,277 | 10/1969 | Reinicke et al. | 335/267 X |
| 3,713,059 | 1/1973 | Tada | 335/259 |
| 3,961,298 | 5/1975 | Jaffe et al. | 335/259 |

FOREIGN PATENT DOCUMENTS

| | | | |
|---|---|---|---|
| 110046 | 6/1928 | Austria | 335/259 |

*Primary Examiner*—George Harris

*Attorney, Agent, or Firm*—Finnegan, Henderson, Farabow, Garrett & Dunner

[57] ABSTRACT

A solenoid-operated plunger device comprising a frame and a solenoid coil contained within the frame. Two or more movable plungers, separated by a barrier, are located within the solenoid coil. The plungers project the ends of the solenoid coil, and are slidable within the solenoid coil on parallel axes. A return spring is connected to each plunger for controlling the movement of the plunger.

20 Claims, 10 Drawing Figures

DUAL PLUNGER SOLENOID DEVICE

BACKGROUND OF THE INVENTION

This invention relates to solenoids and, more particularly, to duel plunger solenoid devices for providing motion in two directions.

Typical solenoid devices, having only a single plunger, provide motion in only one direction upon energization. At the present time, if two directions of operation are desired, then two solenoid devices must be used. Similarly, if the solenoids are to be energized and operated at different levels of voltage, a solenoid device corresponding to each voltage must be used. These limitations of conventional solenoid devices necessitate multiple solenoid attachments, which result in an increase in the cost and space needed for the solenoid device.

Previous solenoid devices are unable to move in two independent directions upon energization at varying voltages. For example, in U.S. Pat. No. 3,961,298 to Jaffe et al., the energization of a second plunger draws a first plunger into contact with an anvil. U.S. Pat. No. 2,946,875 to Waldhauer, Jr. discloses an electromagnetic relay employing two plungers centered within an electromagnetic coil wound on a coil form. When the coil is energized, the plungers move towards each other.

U.S. Pat. No. 3,344,377 to Clements describes a two-way, self-reversing electromagnetic actuator utilizing a common coil, a central plunger segment, and plunger extender elements that longitudinally slide along a central axis.

SUMMARY OF THE INVENTION

The present invention obviates the inherent problems and disadvantages associated with previous solenoid devices. The present invention provides plunger motion in two independent directions; movement of each plunger at a different voltage level; and a less costly and smaller structure.

The present invention provides a solenoid-operated plunger device comprising a frame; a solenoid coil contained within the frame; two or more movable plungers located within the solenoid coil and projecting from the ends of the solenoid coil, the plungers being slidable on parallel axes; a return spring connected to each plunger for controlling the movement of the plunger; and a barrier separating the plungers.

BRIEF DESCRIPTION OF THE DRAWINGS

The accompanying drawings, which are incorporated in and constitute a part of the specification, illustrate at least one embodiment of the invention and, together with the description, serve to explain the principles of the invention.

DESCRIPTION OF THE PREFERRED EMBODIMENT

Figure 1:
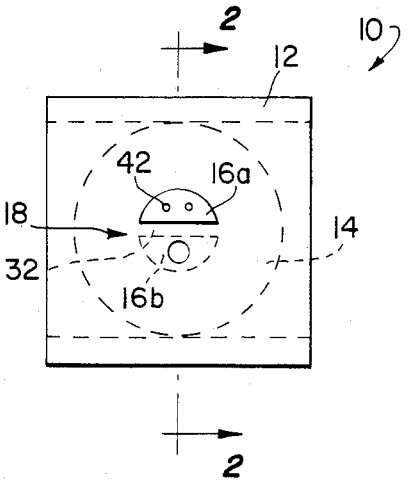
FIG. 1 is a plan view of a solenoid-operated plunger device of the present invention having pull type plungers.

Referring now to FIGS. 1 to 10, a solenoid-operated plunger device 10 of the present invention is shown. The plunger device 10 includes a frame 12, a solenoid coil 14, movable plungers **16*a* and 16*b*, return springs 17, and a barrier 18. The solenoid coil 14 is contained within the frame 12. The plungers 16*a* and 16*b* are located within the same solenoid coil 14, and they project from opposite ends 20*a* and 20*b* of the frame 12. The plungers 16*a* and 16*b* are slidable, within the solenoid coil 14, on parallel axes relative to each other. The barrier 18 separates the plungers 16*a* and 16*b*** from each other.

Figure 2:
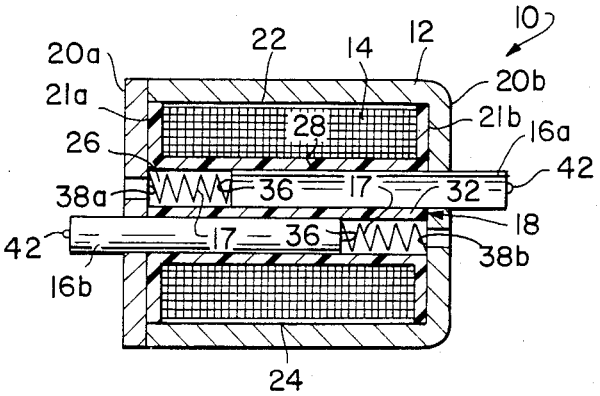
FIG. 2 is a cross-sectional view of the device taken along line 2—2 of FIG. 1.
Figure 3:
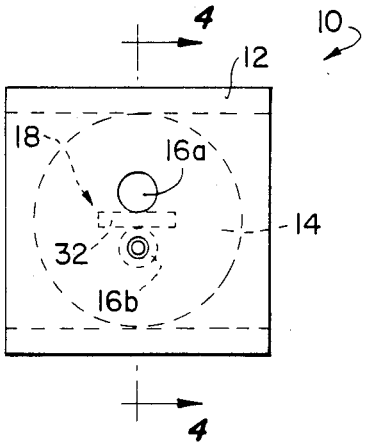
FIG. 3 is a plan view of a solenoid-operated plunger device of the present invention having push type plungers.
Figure 4:
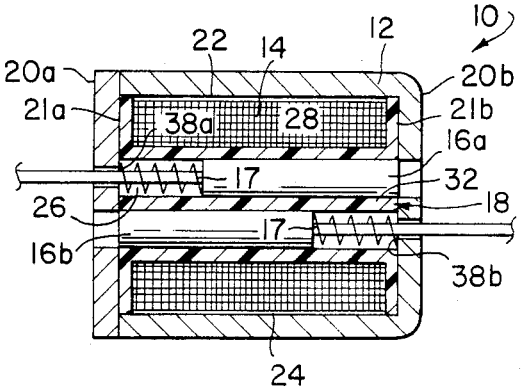
FIG. 4 is a cross-sectional view of the device taken along line 4—4 of FIG. 3.
Figure 6:
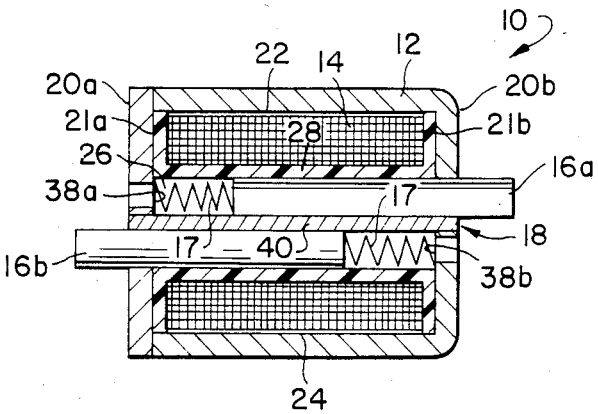
FIG. 6 is a cross sectional view of the device taken along line 6—6 of FIG. 5.
Figure 7:
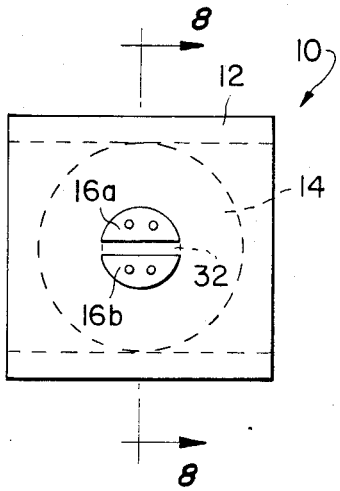
FIG. 7 is a plan view of a solenoid-operated plunger device of the present invention having pull type plungers extending from the same end of the solenoid coil.

The frame 12 can be a closed or boxed frame as shown in FIGS. 2, 4, and 6, or an open or a tubular frame. The closed or boxed frame surrounds the solenoid coil 14 at each end **21*a* and 21*b* of the solenoid coil 14 and on two opposite sides 22 and 24 of the solenoid coil 14. An open frame lies on each end 21*a* and 21*b* of the solenoid coil 14, but on only one side of the coil. A tubular frame completely surrounds the solenoid coil 14 in tubular configuration. Preferably, the frame 12** is made of a highly permeable material, such as cold-rolled S.A.E. 1010 steel.

The solenoid coil 14 is wound around a central core 26 on a coil bobbin 28 within the frame 12. The solenoid coil 14 can be one of many conventional solenoid coils known in the art. Preferably, the solenoid coil 14 is a magnetic wire on either a thermoplastic or thermoset bobbin 28, depending upon the end use of the solenoid-operated plunger device 10.

Figure 8:
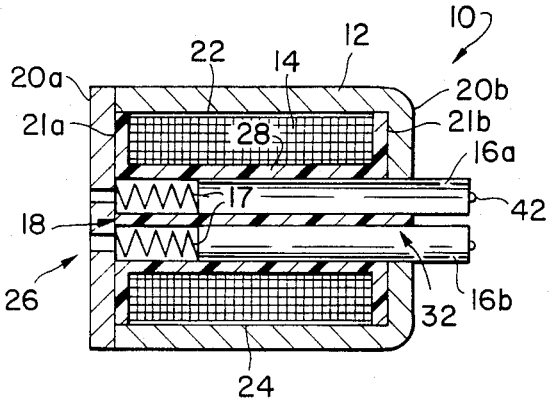
FIG. 8 is a cross-sectional view of the device taken along line 8—8 of FIG. 7.
Figure 9:
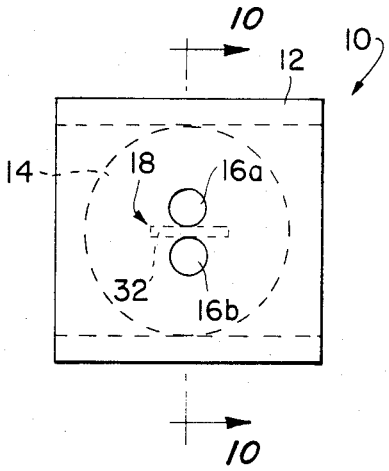
FIG. 9 is a plan view of a solenoid-operated plunger device of the present invention having push type plungers extending from the same end of the solenoid coil.
Figure 10:
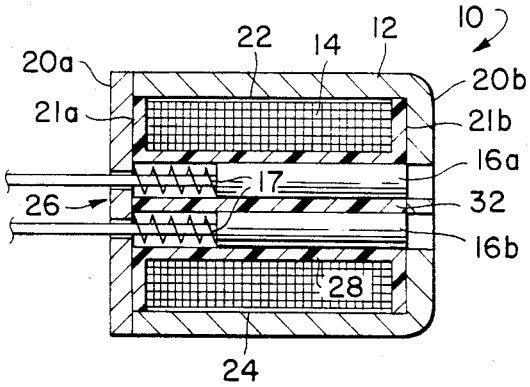
FIG. 10 is a cross-sectional view of the device taken along line 10—10 of FIG. 9.

The plungers **16*a* and 16*b* are located within the same central core 26 and solenoid coil 14. The plungers 16*a* and 16*b* slidably move, within the solenoid coil 14, on a parallel axes with respect to each other. The plungers 16*a* and 16*b* can be either a pull type, as shown in FIGS. 2, 6, and 8 or a push type as shown in FIGS. 4 and 10. The plungers 16*a* and 16*b* are of the pull type when the plungers move towards the interior of the central core 26 of the solenoid coil 14, upon the energization of the solenoid coil 14. The plungers 16*a* and 16*b* are of the push type when the plungers move away from the interior of the central core 26 of the solenoid coil 14, upon energization of the solenoid coil 14. The plungers can project either from opposite ends of the solenoid coil, as in FIGS. 1 to 6, or from the same end of the solenoid coil as in FIGS. 7 to 10**.

Figure 5:
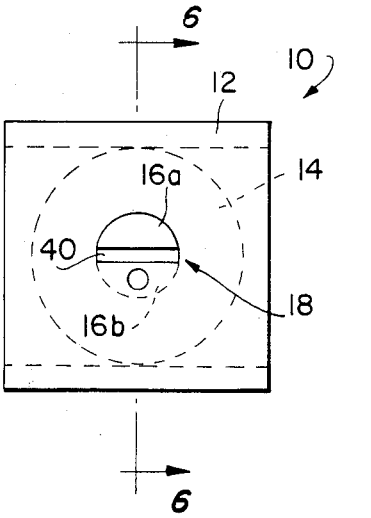
FIG. 5 is a plan view of a solenoid-operated plunger device of the present invention having pull type plungers and a non-ferrous barrier between the plungers.

The barrier 18 separates the plungers **16*a* and 16*b* from each other. In the embodiments shown at FIGS. 1–4, the barrier 18 is a wall portion 32 of the coil bobbin 28. This structure is less costly to construct, since the wall portion 32, serving as the barrier 18, can be molded of a thermoplastic or a thermoset material as part of the coil bobbin 28. Consequently, the wall portion 32 is made of the same material as the coil bobbin 28. For some uses of the solenoid-operated plunger device 10, however, it is preferred, as shown in FIGS. 5–6, that the barrier 18 be a partition 40, that is a separate structure from the coil bobbin 28. Preferably, the partition 40 is made of brass or stainless steel to provide a more suitable barrier for heavy duty applications of the plunger device 10**.

The return spring 17 is connected to each plunger 16*a* and 16*b* to control the movement of the plungers 16*a* and 16*b* upon energization. The return spring 17 may be located internally within the central core 26 of the solenoid coil 14 to connect a base 36 of each plunger 16*a* and 16*b* to a seat 38*a* or 38*b* within the frame 12. Alternatively, the return spring 17 can be attached to each plunger 16*a* and 16*b* either externally of the central core 26 of the solenoid coil 14, or as part of the mechanism to be operated by the solenoid-operated plunger device 10. By having a different spring constant for each return spring 17, each plunger 16*a* and 16*b*, connected to each return spring 17, will move in response to a different voltage level.

The solenoid-operated plunger device 10 further includes a current means for energizing the solenoid coil 14. As embodied herein, the current means includes an alternating current (A.C.) or a direct current (D.C.) electrical circuit.

The solenoid-operated plunger device 10 further includes a means for connecting at least one of the plungers to an external apparatus. As embodied herein, the connecting means includes various types of wire leads 42, solder terminals, quick type terminals, wire wrap, or terminals suitable for P.C. board mounting, as known in the art. The particular connecting means used depends upon the application and environment of the plunger device 10.

The solenoid-operated plunger device 10 can also have more than two plungers 16*a* and 16*b* within the solenoid coil 14. For example, three plungers can be positioned in parallel relationship to each other within the same central core 26 of the solenoid coil 14. Each plunger can have a return spring 17 of a different force constant connected to it to allow each plunger to be activated by a different voltage level. Alternatively, the return springs can have the same force constant. The plungers would be separated from each other by a barrier 18. Such a construction of the plunger device 10 would produce a multi-level voltage indicator device.

In operation, the direction of movement of the plungers 16*a* and 16*b* depends on the level of the current activating the solenoid coil and on the type of plungers 16*a* and 16*b* used in the plunger device 10. For example, in the pull type plunger shown in FIGS. 1–2, when current is applied to the solenoid coil 14, pull type plunger 16*a* moves through the interior 30 of the central core 26 of the solenoid coil 14 to the seat 38*a* on the frame 12. The plunger 16*b* will move in an opposite direction towards seat 38*b* at the same or different time depending upon the spring constant and voltage level. Another method of operation is to have the solenoid coil 14 divided into a two part coil, each part covering one-half of the bobbin. Each solenoid part is capable of activating the plungers.

Additionally, a combination of push and pull type plungers could be in a common solenoid coil with each plunger being activated at different voltage levels depending upon the spring constant.

It will be apparent to those skilled in the art that various other modifications and variations could be made in the structure of the invention without departing from the scope and content of the invention.

What is claimed is:

1. A solenoid-operated plunger device comprising:
(a) a frame;
(b) a solenoid coil contained within the frame;
(c) two or more movable plungers located within the solenoid coil and projecting from the ends of the solenoid coil, the plungers being independently slidable within the solenoid coil on parallel axes;
(d) a return spring connected to each plunger for controlling the movement of the plunger; and
(e) a barrier separating the plungers.

2. The solenoid-operated plunger device as in claim 1, wherein the plungers are pull type plungers.

3. The solenoid-operated plunger device as in claim 1, wherein the plungers are push type plungers.

4. The solenoid-operated plunger device as in claim 1, wherein the barrier is a portion of a coil bobbin.

5. The solenoid-operated plunger device as in claim 4, wherein the coil bobbin is made of a material selected from the group consisting of thermoplastics and thermosets.

6. The solenoid-operated plunger device as in claim 1, wherein the barrier is made of a material selected from the group consisting of stainless steel and brass.

7. The solenoid-operated plunger device as in claim 1, wherein each return spring has a different spring constant.

8. The solenoid-operated plunger device as in claim 1, further comprising a current means for energizing the solenoid coil.

9. The solenoid-operated plunger device as in claim 8, wherein the current means is an alternating current electrical circuit.

10. The solenoid-operated plunger device as in claim 8, wherein the current means is a direct current electrical circuit.

11. The solenoid-operated plunger device as in claim 1, wherein the number of movable plungers within the solenoid coil is two.

12. The solenoid-operated plunger device as in claim 1, further comprising means for connecting at least one of the plungers to an external apparatus.

13. The solenoid-operated plunger device as in claim 1, wherein the movable plungers project from opposite ends of the solenoid coil.

14. The solenoid-operated plunger device as in claim 1, wherein the movable plungers project from the same end of the solenoid coil.

15. The solenoid-operated plunger device of claim 1, wherein two of the movable plungers slide in opposite directions upon energization of the solenoid coil.

16. A solenoid-operated plunger device comprising:
(a) a frame;
(b) a solenoid coil contained within the frame;
(c) two movable plungers located within the solenoid coil and projecting from the ends of the solenoid coil, the plungers being independently slidable within the solenoid coil on parallel axes;
(d) a return spring connected to each plunger for controlling the movement of the plunger, each return spring having a different spring constant; and (e) a barrier separating the plungers.

17. The solenoid-operated plunger device of claim 16, wherein the movable plungers slide in opposite directions upon energization of the solenoid coil.

18. The solenoid-operated plunger device of claim 16, wherein the movable plungers project from opposite ends of the solenoid coil.

19. The solenoid-operated plunger device of claim 16, wherein the plungers are pull type plungers.

20. The solenoid-operated plunger device of claim 16, wherein the plungers are push type plungers.

* * * * *